US005244442A

United States Patent [19]

Schill

[11] Patent Number: 5,244,442

[45] Date of Patent: Sep. 14, 1993

[54] PORTABLE WRIST EXERCISE DEVICE UTILIZING FRICTIONAL RESISTANCE

[76] Inventor: John M. Schill, 208 Samuel Street, Kitchener, Ontario, Canada, N2H 1R6

[21] Appl. No.: 917,645

[22] Filed: Jul. 23, 1992

[51] Int. Cl.[5] ..... A63B 5/00

[52] U.S. Cl. ..... 482/45; 482/46; 482/114

[58] Field of Search ..... 482/45, 46, 44, 49, 482/114, 115

[56] References Cited

U.S. PATENT DOCUMENTS

| | | | |
|---|---|---|---|
| 684,117 | 10/1901 | Sloan, Jr. . | |
| 2,668,055 | 1/1954 | Sharp et al. . | |
| 2,714,008 | 6/1955 | Urban . | |
| 2,973,962 | 9/1961 | Griffin . | |
| 3,084,547 | 4/1963 | Nielsen | 482/49 |
| 3,184,234 | 5/1965 | Struble . | |
| 3,211,453 | 10/1965 | Williams . | |
| 3,396,967 | 10/1968 | Brown . | |
| 3,649,008 | 11/1972 | Zunken et al. . | |
| 3,717,338 | 4/1973 | Hughes . | |
| 3,764,131 | 6/1973 | Rooks . | |
| 3,830,493 | 9/1974 | Miller . | |
| 4,095,789 | 8/1978 | Mueller . | |
| 4,155,547 | 5/1979 | Savio et al. . | |
| 4,171,802 | 10/1979 | Stoecker . | |
| 4,337,937 | 7/1982 | Lopez . | |
| 4,344,615 | 8/1982 | Carlson | 482/46 |
| 4,438,920 | 3/1984 | Veillette | 482/46 |
| 4,591,151 | 5/1986 | Hensley . | |
| 4,643,417 | 4/1987 | Nieman . | |
| 4,695,049 | 11/1987 | Ciemiega . | |
| 4,901,999 | 2/1990 | Schott . | |
| 4,913,417 | 4/1990 | Francu | 482/45 |

FOREIGN PATENT DOCUMENTS

| | | | |
|---|---|---|---|
| 1183131 | 10/1985 | U.S.S.R. | 482/44 |
| 1588973 | 5/1981 | United Kingdom | 482/46 |
| 2107596 | 5/1983 | United Kingdom | 482/46 |
| 2229934 | 10/1990 | United Kingdom | 482/44 |

OTHER PUBLICATIONS

Advertisement in Southern Links Magazine Nov. 17, 1989 p. 77 concerning Power-Stik.

*Primary Examiner*—Richard J. Apley
*Assistant Examiner*—Jeanne M. Mollo
*Attorney, Agent, or Firm*—Rogers & Scott

[57] ABSTRACT

A portable exercise device for the wrists, hands and arms having an elongate shaft of generally circular cross section, a pair of handles connected to the shaft, at least one of the handles having a substantially axial bore in which the shaft is inserted. Clamping means is provided for clamping said at least one of the handles to the shaft to permit relative circumferential movement about said shaft of said at least one of the handles, the movement being opposed by frictional force between the shaft and the bore of said at least one of the handles.

4 Claims, 1 Drawing Sheet 30
32
34
36
38
40
42
44
46
48
50
52
54
56
58
60
62
64
66
68
3
4
6

PORTABLE WRIST EXERCISE DEVICE UTILIZING FRICTIONAL RESISTANCE

This invention relates to portable exercising devices for exercising the wrists, hands and arms, of the type having two aligned handles which in use, are turned in opposite directions against a resisting force.

Exercising the wrists, hands and arms is very important for many people, for example those who play hockey or participate in racquet sports or club sports such as golf or baseball. In hockey for example, wrist strength is a key element in a wrist shot, snap shot and slap shot. With these types of shots, the speed at which a puck travels may determine the puck's success in by passing opponents and perhaps crossing the goal line.

It is desirable for such an exercise device to be portable so that it can be used when and where desired.

Many devices are known which provide two handles which can be twisted about a shaft for wrist exercise. These devices usually comprise an axial adjustment which forces plates, brakes or pads together to cause friction when twisting the handles circumferentially. Examples are shown in U.S. Pat. Nos. 684117, 2,668,055, 3,184,234, 3,211,453, 3,764,131, 3,830,493, 4,095,789, 4,171,802, 4,337,937, 4,643,417 and 4,695,049. Also common are devices which use springs to react against twisting of the handles. Examples are shown in U.S. Pat. Nos. 2,714,008, 2,973,962, 3,396,967 and 4,591,151. Often these categories of devices require parts located inside the shaft adding to cost and service problems.

Devices with handles rigidly attached to a shaft clamped to a wall or other structure are shown in U.S. Pat. Nos. 3,649,008 and 4,344,615. These devices of course are not portable.

U.S. Pat. No. 4,901,999 shows a device with handles mounted on balls at the ends of a shaft. Although this permits twisting of the handles about any axis, similar benefits to the wrist can be achieved with handles that twist about only one axis by simply altering the grip of the hands on the handles. A device that has handles that twist about only one axis provides a more convenient storage shape, especially when transported in a hockey or duffle bag because snaggable protrusions such as the end handles shown in U.S. Pat. No. 4,901,999 can be eliminated, and also does not require the provision of balls on the ends of the shaft.

Consequently, it is among the objects of the invention to provide an improved wrist exercise device that is portable and provides an inexpensive way to exercise the wrist, hand and arm.

According to the invention there is provided, a portable exercise device for the wrists, hands and arms having an elongate shaft of generally circular cross section, a pair of handles connected to the shaft, at least one of the handles having a substantially axial bore in which the shaft is inserted. Clamping means is provided for clamping said at least one of the handles to the shaft to permit relative circumferential movement about the shaft of said at least one of the handles, the movement being opposed by frictional force between the shaft and the bore of said at least one of the handles. In a preferred embodiment, the clamping means includes a screw to facilitate adjustment of frictional force between the bore of said at least one of the handles and said shaft. The shaft has a portion of lesser circumference defining a radial groove within the bore of said at least one of the handles and said at least one of the handles has an insert protruding into the groove to prevent said at least one of the handles from axial motion relative to said shaft. The screw passes through the groove thereby reducing the required width of said at least one of the handles. The handles of the device have a generally rectangular cross section and said at least one of the handles has an axial slot extending from the exterior to the axial bore to give said at least one of the handles a substantially C-shaped cross section to facilitate clamping.

Embodiments of the invention will now be described, by way of example, with reference to the accompanying drawings of which:

Figures 1, 2, 3, 4, 5, 6:
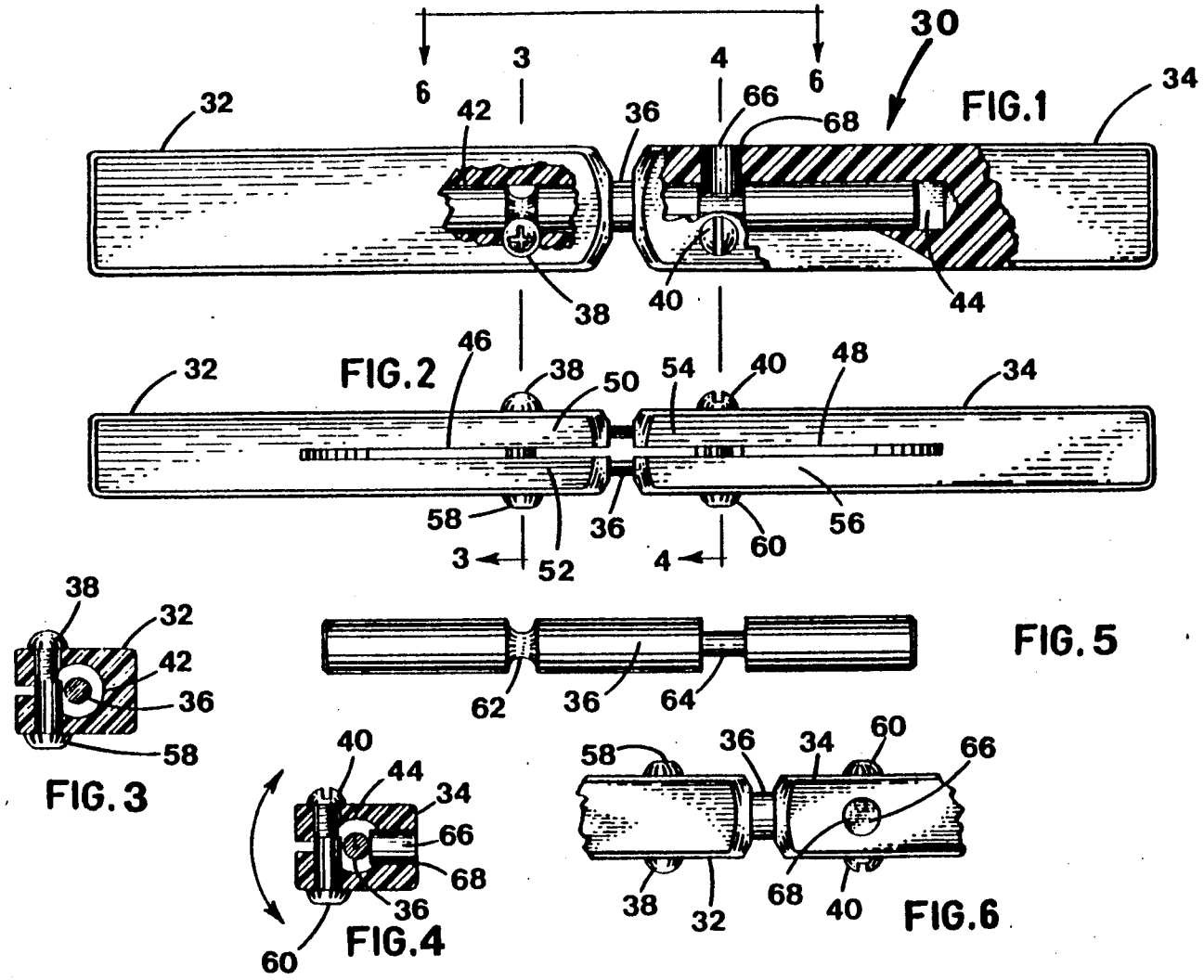
FIG. 1 is a partially cut away top view of an exercise device according to the invention.
FIG. 2 is a side view of the device.
FIG. 3 is a sectional view on line 3—3 of FIG. 1.
FIG. 4 is a sectional view on line 4—4 of FIG. 1.
FIG. 5 is a side view of the shaft.
FIG. 6 is a partial side view on line 6—6 and FIG. 1.

Reference is made firstly to FIG. 1 wherein an exercise device 30 is illustrated. In operation, a person grips handles 32, 34, one in each hand and rotates the handles 32, 34 in opposite directions about a shaft 36 which has a circular cross section.

To exercise the muscles, there must be friction when rotating handles 32, 34. In accordance with this embodiment of the invention a screw 38 clamps the handle 32 to the shaft 36 thereby preventing relative motion, and adjusting screw 40 clamps the second handle 34 to the shaft with a lesser clamping force, thereby allowing the handle 34 to be rotated about the shaft 36 against the frictional force caused by the clamping.

As seen in FIG. 1, the handles 32, 34 have respective bores 42, 44 both having a circular cross section in which the shaft 36 snuggly fits. To facilitate clamping, slots 46, 48 respectively as seen in FIG. 2 are provided in the handles 32, 34. The slots 46, 48 extend from the outside of the handle 32 or 34 to the bore 42 or 44 and extend from the inner ends of the handle 32 or 34 to about halfway along the handle length. This gives the handle a generally C-shaped cross section at this location. Thus, screws 38, 40 are used to pull together the edges 50, 52 and 54, 56 respectively, so the bores 42, 44 tighten around and onto the shaft 36 to produce the desired friction.

FIGS. 3 and 4, show sleeve nuts 58, 60 respectively, used for retention of the screws 38, 40.

FIG. 5 shows the shaft 36 which has circumferential grooves 62, 64. The grooves 62, 64 are positioned so that they substantially align with the centre lines of the screws 38, 40. Therefore, the screws 38, 40 and the sleeve nuts 58, 60 pass through the grooves to fit conveniently in the handles 32, 34 without requiring excess handle material. The grooves 62, 64 also prevent the handles 32, 34 from shifting axially with respect to the shaft 36 during use.

Since the handle 32 is clamped tightly so that there is no motion relative to the shaft 36, it is not necessary to be concerned about contact between the shaft 36 and the screw 38 or the nut 58 wearing down the parts. The other handle 34, however, is not clamped tightly enough to prevent axial movement. Therefore to reduce relative axial movement and to ensure there is no contact between the screw 40 or the nut 60 and the shaft 36, an insert 66 made of Nylon (TM) or other suitable material, is positioned through a hole 68 in the handle as seen in FIGS. 1, 4 and 6. The diameter of the insert 66 is larger than that of the screw 40 or the nut 60 and fits in groove 64 in the shaft 36. Thus, if the shaft 36 and handle 34 are forced to move axially in either direction, the insert 66 engages the ends of the groove 64 in the shaft 36 and axial motion is stopped.

When using the device 30, many variations are possible. Both arms can be extended, gripping the handles from above, then the handles can be turned in opposite directions. An alternative is the same motion with the elbows bent and the wrists near the body. In a further example, the hands grip the device like a hockey stick, golf club or bat and twist the handles in opposite directions.

As muscle development warrants, the friction in the device 30 can be increased by turning the screw 40 in a clockwise direction using a screwdriver or dime or other such object.

It will be evident that, when connecting the handles to the shaft, only one handle needs to have an adjustable screw such as handle 34. The other handle can be tightly clamped and left as such, as in handle 32, or the handle can be permanently coupled to the shaft or even made integral with the shaft.

In the preferred embodiment, the handles are made of wood having the shape and feel of hockey stick handles. The shaft is made of approximately 1.2 cm diameter steel rod, although other sizes and materials are acceptable as long as strength and durability are maintained.

Other embodiments of the invention will be readily apparent to a person skilled in the art, the scope of the invention being defined in the appended claims.

I claim:

1. A portable exercise device for the wrists, hands and arms comprising:

an elongate shaft of generally circular cross section;

a pair of handles connected to said shaft, at least one of said handles having a substantially axial bore in which said shaft is inserted; and adjustable clamping means for clamping said at least one of said handles to said shaft to permit relative circumferential movement about said shaft of said at least one of said handles, said movement being opposed by frictional force between said shaft and said bore of said at least one of said handles, said at least one of said handles having an axial slot extending from the exterior to said axial bore to give said at least one of said handles a substantially C-shaped cross-section to permit adjustable clamping, said adjustable clamping means including an adjustable screw passing through said at least one of said handles and said slot therein to enable the frictional force between said bore of said at least one of said handles and said shaft to be adjusted, and said shaft having a portion of lesser circumference defining a radial groove through which said adjustment screw passes thereby reducing the required width of said at least of one of said handles.

2. A device as claimed in claim 1 wherein said at least one of said handles has an insert protruding into said groove to prevent said at least one of said handles from axial motion relative to said shaft.

3. A device as claimed in claim 1 wherein said handles have a generally rectangular cross section.

4. A device as claimed in claim 1 wherein one handle is provided with said axial bore and said adjustable clamping means, and the other handle is connected to said shaft to prevent relative circumferential movement of said other handle about said shaft.

* * * * *